United States Patent [19]

Caldicott et al.

[11] 4,340,020

[45] Jul. 20, 1982

[54] GOVERNOR MECHANISM

[75] Inventors: Laurence C. Caldicott, Watford; Alastair D. Cameron; Georgs N. Felton, both of London, all of England

[73] Assignee: Lucas Industries Limited, Birmingham, England

[21] Appl. No.: 88,837

[22] Filed: Oct. 29, 1979

[30] Foreign Application Priority Data

Nov. 11, 1978 [GB] United Kingdom ..... 44176/78

[51] Int. Cl.[3] ..... F02D 1/04

[52] U.S. Cl. ..... 123/374; 123/365

[58] Field of Search ..... 123/364–374

[56] References Cited

U.S. PATENT DOCUMENTS

| | | | |
|---|---|---|---|
| 2,539,738 | 1/1951 | Grim et al. | 123/374 |
| 3,185,141 | 5/1965 | Miracki et al. | 123/373 |
| 3,830,211 | 8/1974 | Bechstein et al. | 123/374 |
| 3,902,470 | 9/1975 | Tomsett | 123/373 |
| 3,973,542 | 8/1976 | Shum | 123/373 |
| 4,109,628 | 8/1978 | Miller et al. | 123/372 |
| 4,109,629 | 8/1978 | Potter | 123/374 |

*Primary Examiner*—Ira S. Lazarus
*Assistant Examiner*—Magdalen Moy
*Attorney, Agent, or Firm*—Balogh, Osann, Kramer, Dvorak, Genova & Traub

[57] ABSTRACT

A governor mechanism in or for a fuel injection pump includes a centrifugal weight mechanism which effects movement of a member against the action of a pre-loaded resilient means. The member is coupled to one end of a lever the other end being coupled to a fuel quantity control member of the pump. The lever is mounted on an adjustable pivot. Means is provided to reduce the preload of the resilient means and to position the pivot to ensure a supply of fuel by the pump when it is required that the engine should operate at a reduced speed with a varying load.

8 Claims, 11 Drawing Figures

Figure 1:
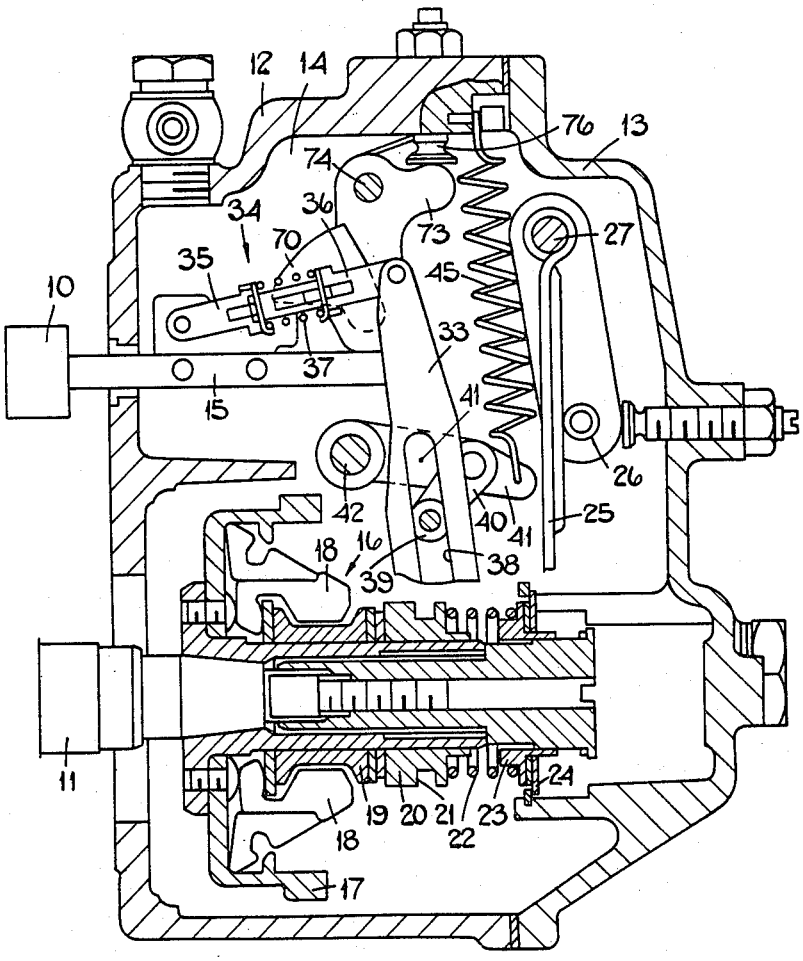

FIG.4.
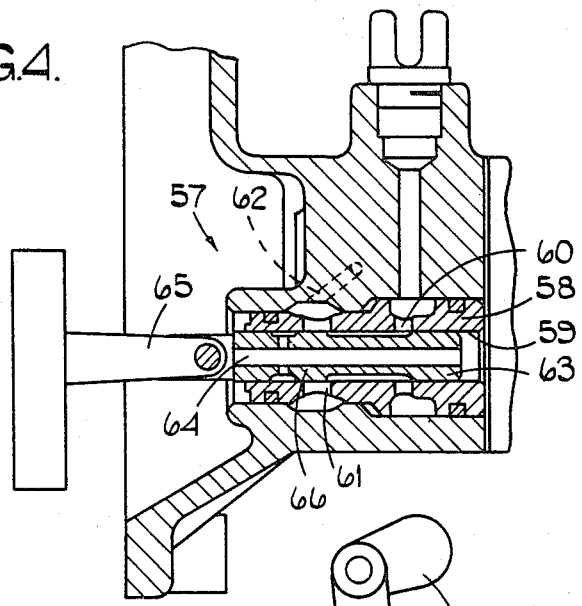
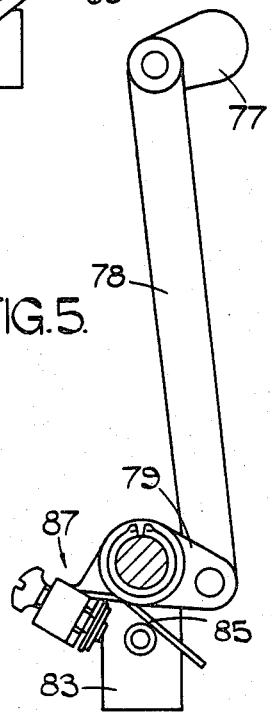
FIG.5.

98
100
99
102
97
95
101
47
93
92
42
47
94
96

GOVERNOR MECHANISM

This invention relates to a governor mechanism for use with or forming part of a fuel injection pumping apparatus for supplying fuel to an internal combustion engine, the mechanism comprising a centrifugal weight unit which in use, is driven at a speed proportional to the speed of the associated engine, a first resilient means acting against a member in opposition to the force exerted by said weight unit, means for limiting the deflection of said first resilient means, a second preloaded resilient means which defines a reaction member for said first resilient means, the preload of said second resilient means being substantially equal to the force required to deflect the first resilient means its maximum permitted extent, whereby with increasing engine speed said member is moved continuously against the action of said first and second resilient means, a lever pivotally mounted intermediate its ends, means coupling one end of said lever to said member so that the lever is pivoted about its point upon movement of said member, further means connecting the other end of said lever to a control member of the pumping apparatus, and manually adjustable means for varying the position of said pivot whereby for a given position of said member below the maximum speed of the engine, when the pivot is moved in one direction the lever will pivot in a direction which effects an increase in the amount of fuel supplied to the engine and when the pivot is moved in the other direction the lever will pivot in a direction which effects a reduction in the amount of fuel supplied to the engine.

Such governor mechanism acts as an all speed governor whereby for a given setting of the pivot, as the engine speed increases beyond a value appropriate to the position of the pivot the amount of fuel supplied to the engine will decrease thereby tending to minimise the rise in engine speed and vice versa.

The governing ability does however, vary with the position of the pivot and with the engine speed and at low to intermediate engine speeds with the pivot in the appropriate position the ability of the governor to control the engine speed is lower than the case where the engine speed is in its upper range and with the pivot set at the appropriate position. There are two effects which combine to impair the governing ability in the low to intermediated speed ranges. The first effect is due to the lever ratio of the lever. At pivot positions appropriate for operation in the low to intermediate speed ranges the lever ratio is such that there must be a larger movement of the member to achieve a given change in the amount of fuel supplied to the engine than is the case when the lever ratio is appropriate for operation in the upper speed range. The second effect is due to the characteristic of the weight unit. At higher speeds there is a greater movement of the member for a given change in the engine speed than is the case at the lower speeds.

The variation in the governing ability described above does not have any significance when the associated engine is driving a road vehicle, however, a difficulty can arise when the vehicle is fitted with a power take off coupling and the need arises to operate the engine in the low to intermediate speed range. In this condition, if the operator adjusts the pivot to provide the desired engine speed then as the load on the engine varies, there will be a considerable variation in the engine speed and the engine speed can only be maintained constant by adjustment of the manually adjustable means by the operator. This is inconvenient since it means that the operator must be in constant attendance to ensure that the device driven from the power take off coupling is operating at its correct speed.

The object of the present invention is to provide a governor mechanism of the kind specified in a form in which it is suited to control the speed of the associated engine when a power take off coupling is in use.

According to the invention a governor mechanism of the kind specified includes extra means for adjusting the preload of said second resilient means, said extra means being coupled to linkage means which is operable from the exterior of the governor mechanism to reduce the preload of said second resilient means when it is required to operate the engine at a reduced speed with a varying load.

Figure 2:
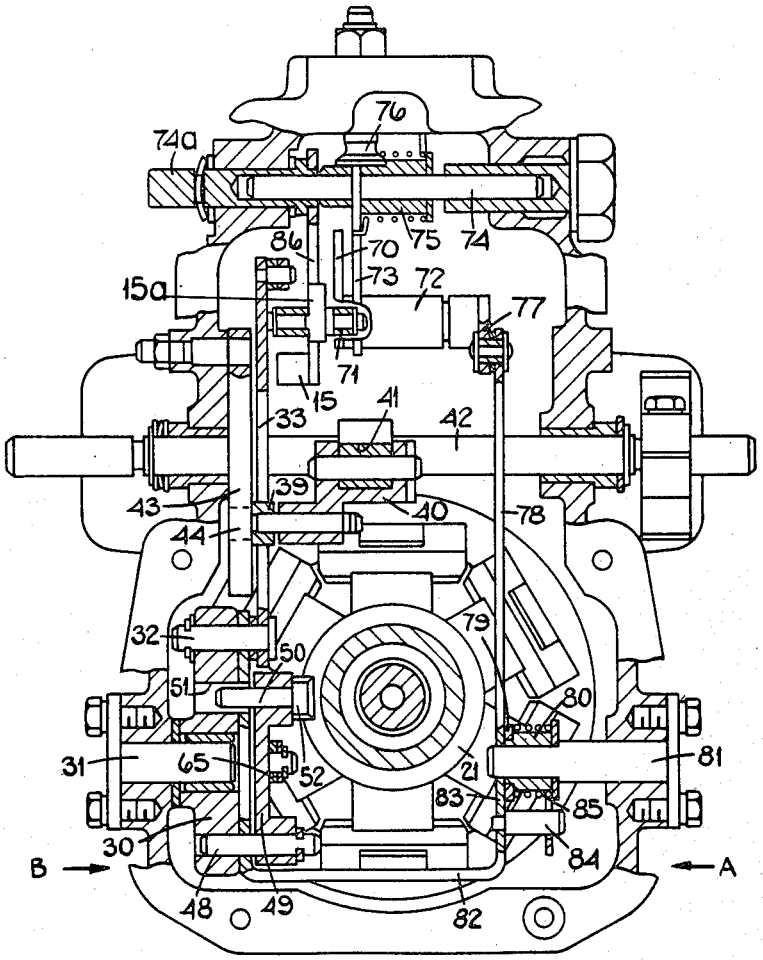
Figure 3:
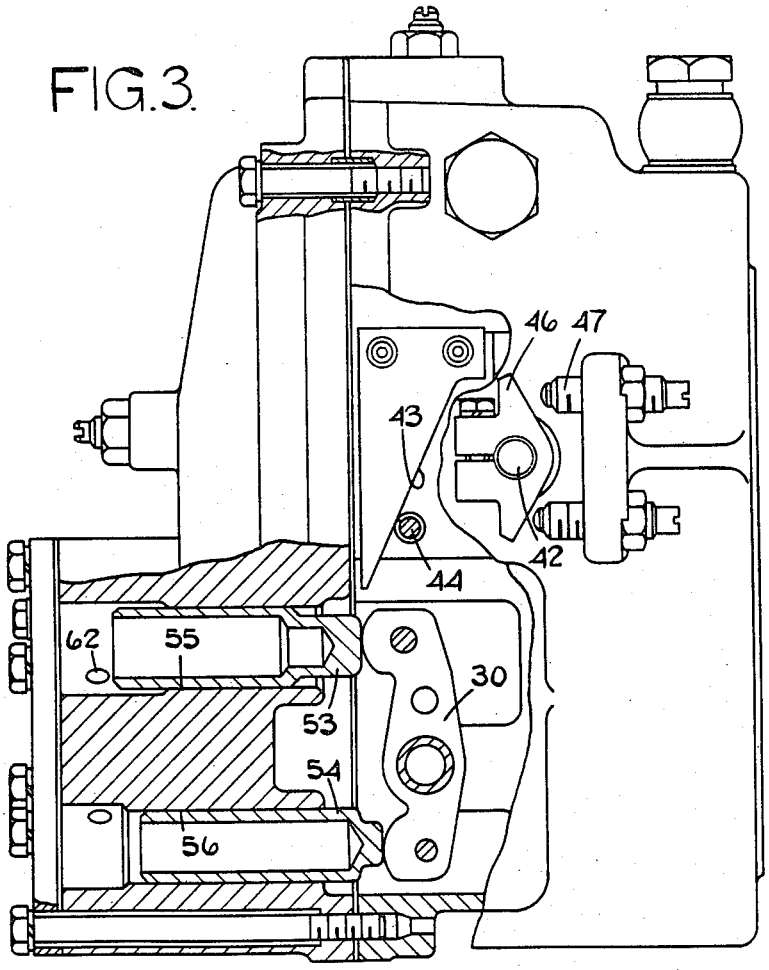
Figure 6:
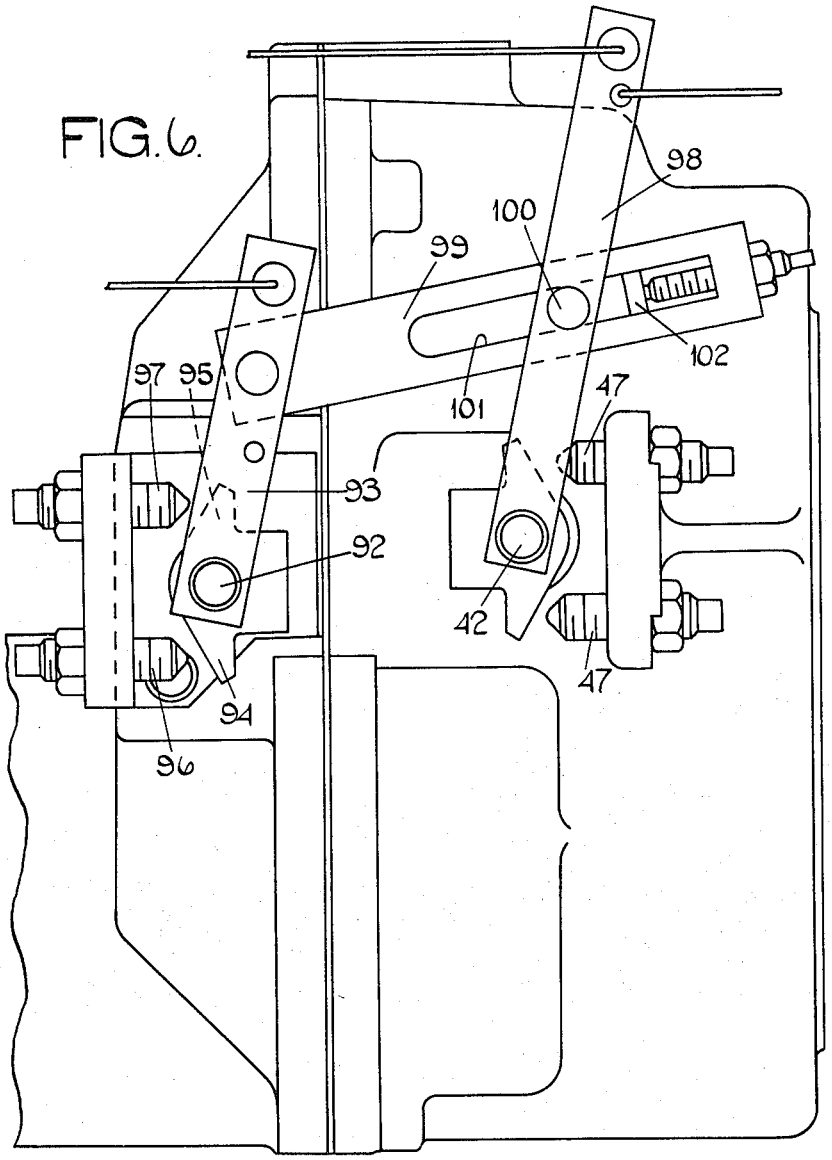
Figure 7:
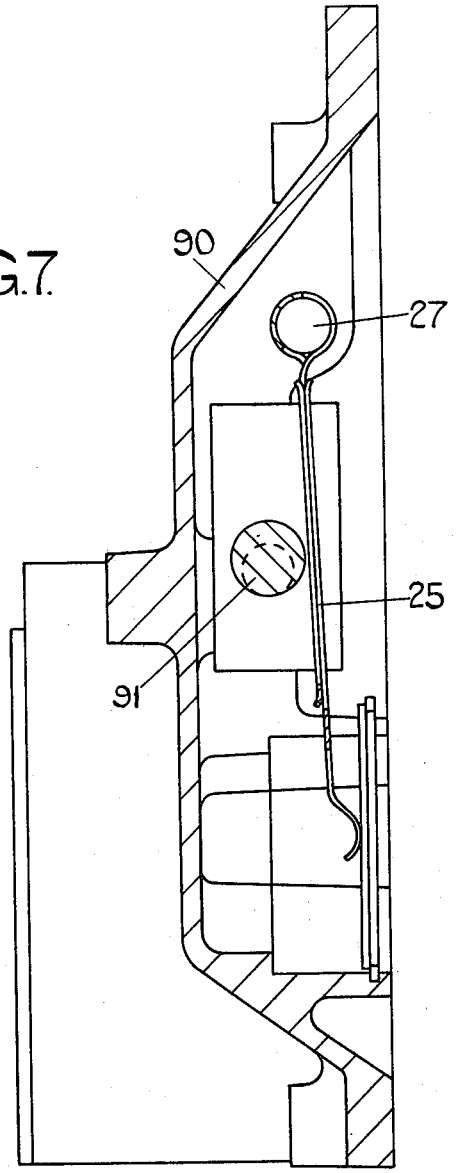
Figure 9:
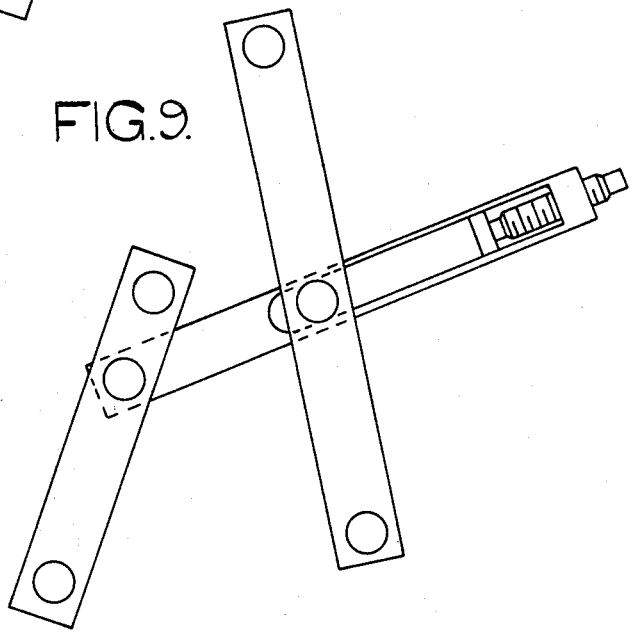
Figure 10:
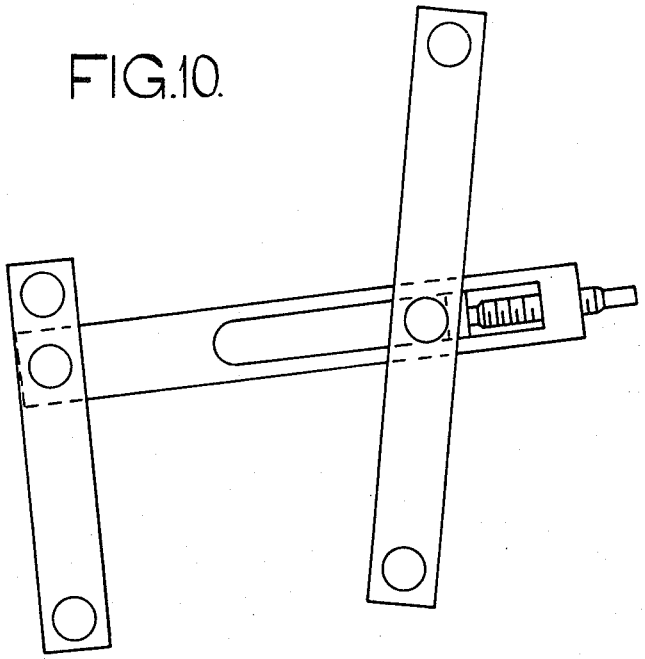
Figure 11:
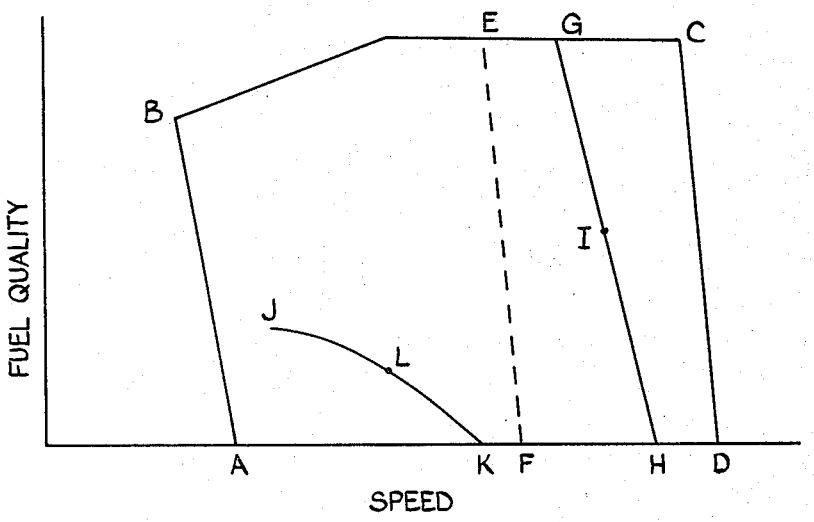

One example of a mechanism in accordance with the invention will now be described with reference to the accompanying drawings in which:

FIG. 1 is a side elevation with parts removed for the sake of clarity, looking in the direction of the arrow (B) of FIG. 2, FIG. 2 is a sectional end elevation, FIG. 3 is a view in the direction of the arrow (A) of FIG. 2 and again with parts removed for the sake of clarity, FIG. 4 is a sectional view of a portion of the apparatus not seen in the remaining Figures, FIG. 5 is a scrap view of a portion of the apparatus looking in the direction of the arrow (A) of FIG. 2, FIG. 6 is a view similar to FIG. 3 of the exterior of the governor mechanism and showing the modifications in accordance with the invention, FIG. 7 shows the internal modification necessary to the apparatus shown in FIG. 1, FIGS. 8, 9 and 10 are views showing different positions of the linkage which is shown in FIG. 6 and FIG. 11 is a graph showing various curves obtained with the governor mechanism.

With reference to the drawings the governor mechanism comprises a housing 12 into which extends a shaft 11 which constitutes the drive shaft of the pumping apparatus with which the mechanism is associated. The pumping apparatus comprises a plurality of injection pumps which are indicated at 10, the individual injection pumps being operated by cams respectively, mounted on the shaft 11.

The housing 12 is provided with an end closure 13 which together with the housing defines a chamber 14 into which extends an axially movable fuel control rod 15 the axial setting of which determines the amount of fuel which is delivered by the injection pump.

The shaft 11 carries a centrifugal weight unit which is generally indicated at 16 and which includes a cup-shaped member 17 secured to the shaft, the cup-shaped member housing a plurality of governor weights 18. The shaft is driven in timed relationship with the associated engine and therefore its speed is proportional to the engine speed. As the shaft rotates the weights 18 move outwardly under the action of centrifugal force and in so doing impart axial movement to a sleeve 19. The sleeve 19 in turn imparts axial movement to a further sleeve 20 through the intermediary of a thrust bearing and in the sleeve 20 is formed a circumferential groove 21. Interposed between the sleeve 20 and a further sleeve 23 is a light coiled compression spring 22. The sleeve 23 engages a plate 24 which is accommodated within a recess which is defined in a hollow projection formed on the end closure 13. The plate 24 can move axially. Moreover, it is engaged by one end of a leaf spring 25. The extent of movement of the plate 24 under the action of the leaf spring is determined by a circlip which is located within the wall of the recess formed in the projection and the force which can be imparted to the plate 24 by the leaf spring is determined by means of an adjustor 26 which in practice is pre-set so that the spring is preloaded.

In operation as the speed at which the shaft rotates increases, the weights move outwardly and the sleeve 20 moves towards the sleeve 23 initially against the action of the spring 22. The extent by which the spring 22 can be compressed is limited by the abutment of the two sleeves. Such movement as described takes place at a relatively low speed and it would be understood that the spring 22 constitutes the governor spring when the engine is idling. When the spring 22 has been compressed its maximum amount, the force exerted by the weights is opposed by the spring 25 and the preload of this spring is such that it is substantially equal to the force exerted by the spring 22 in its fully compressed state. As a result the position of the sleeve 20 will depend upon the speed of the associated engine.

Referring also to FIG. 2 there is provided a rockable member 30 which is pivotally mounted about a pin 31 secured within the housing 12. The upper portion of the member 30 constitutes a first link and it carries a pivot pin 32 about which is mounted one end of a lever 33. The other end of the lever 33 is connected to the control rod 15 by way of lost motion connection 34. The connection 34 comprises a pair of members 35, 36 which are movable axially in either direction relative to each other. Whichever the direction of axial movement the movement is opposed by a coiled compression spring 37 which is preloaded. Hence until the preload of the spring 37 is overcome, movement of the member 36 will result in similar movement of the member 35 and hence movement of the control rod 15.

The lever 33 intermediate its ends, is provided with a longitudinal slot 38 within which is slidable a block 39 carried by one arm of a bell crank lever 40. The lever 40 is pivotally mounted on an operator controlled lever 41 which is carried by a shaft 42 which extends to the exterior of the housing and in use, is coupled to the throttle pedal of the vehicle of which the associated engine forms part. The block 39 constitutes an adjustable pivot for the lever 33 and when the shaft 42 is moved angularly the block 39 moves within the slot 38, its path of movement being determined by a ramp surface 43 against which bears a roller 44 carried by the block 39. As the shaft 42 is moved angularly the block 39 moves parallel to the ramp surface and as previously mentioned alters the pivot point of the lever 33. The other arm of the lever 40 is connected to one end of a coiled tension spring 45 the other end of which is secured to the housing. The spring 45 acts to bias the shaft 42 angularly to the minimum power setting and to bias the roller 44 into contact with the ramp surface 43. Exterior of the housing and as shown in FIG. 3, the shaft 42 mounts an abutment member 46 which defines a pair of limbs engageable with a pair of stops 47 respectively. These act to limit the extent of angular movement of the shaft, 42.

The member 30 on its other limb carries a pivot pin 48 and pivotally mounted on this pin is a pivotal member 49. The member 49 carries on the opposite side of the pivot pin 31, a pin 50 which extends into an enlarged aperture 51 formed in the member 30. The pin 50 also carries a slipper 52 which is located in the circumferential groove 21 in the aforesaid sleeve 20. It will be noted that the pivot pin 31 is off set relative to the axis of rotation of the shaft 11 and that the axis of the pin 50 extends at right angles to the axis of rotation of the shaft. The pin 50 is provided to ensure that governing of the engine speed takes place even if a servo mechanism to be described should fail. When the sleeve 20 is moved by the weight unit, movement will be imparted to the slipper 52 and also the pivotal member 49. Such movement will occur until the pin 50 engages the surface of the aperture 51 and further movement of the pivotal member 49 will be transmitted to the member 30 which will move angularly about the pin 31. Such angular movement will effect movement of the lever 33 in the direction about its pivot axis, to reduce the amount of fuel supplied to the engine A servo mechanism is provided which effects angular movement of the member 30 about the pin 31 and any force which is required to move the member 30 is derived from the servo mechanism so that the weight mechanism is not loaded by the aforesaid forces. As shown in FIG. 3 the opposite ends of the member 30 are engageable by a pair of pistons 53, 54 which are housed within respective cylinders 55, 56 The diameter of the cylinder 55 is greater than that of the cylinder 56 and the axes of the two cylinders are substantially parallel to each other. The cylinder 56 is in constant communication with a source of liquid under pressure and the admission of the liquid under pressure to or the release of liquid from the cylinder 55 is controlled by a servo valve generally indicated at 57 in FIG. 4. The valve 57 comprises a fixed sleeve 58 in which is formed a bore 59. Opening into the bore are a pair of ports 60, 61 and the port 60 communicates with the source of fluid under pressure. The port 61 communicates with the cylinder 55 by way of a passage 62. Slidable within the bore is a valve element 63 having formed therein a longitudinally extending bore 64 open to chamber 14. The valve element 63 is coupled by means of a link 65 to the pivotal member 49, the pivotal connection being intermediate the pins 48 and 50.

Formed in the periphery of the valve element 63 is a pair of grooves between which is defined a land 66. The land 66 controls the size of the port 61 and one of the aforesaid grooves is in constant communication with the port 60 whilst the other communicates with the passage 64 by way of a transverse drilling.

In operation, when the valve element is moved towards the left as seen in FIG. 4, the port 61 is placed in communication with the groove which is in constant communication with the source of liquid. As a result liquid under pressure is admitted to the cylinder 55 and the piston 53 effects clockwise movement of the member 30 as seen in FIG. 3. conversely, if the valve element is moved towards the right then the groove which is in communication with the chamber, is brought into register with the port 61 and the cylinder 55 is therefore placed in communication with the chamber thus reducing the liquid pressure in the cylinder 55. This allows the piston 54 to move the member 30 in the anti-clockwise direction as seen in FIG. 3. The movement of the valve element is controlled by the pivotal member 49 and movement of this member is effected by the sleeve 20. As a result when the sleeve 20 moves in either direction, movement of the member 49 will occur and this will effect movement of the valve element. However, since the member 49 is pivotally mounted upon the member 30 which is moved by the pistons, only limited movement of the member 30 will occur until the port 61 is covered by the land 66. The servo mechanism is therefore a follow up servo mechanism and the member 30 will pivot about the pin 31 by an amount determined by the movement of the slipper 52 by the sleeve 20. In the event that the supply of liquid under pressure fails then as previously described, the member 49 can be coupled to the member 30 by means of the pin 50 so that the weight unit in an emergency can effect a reduction in the amount of fuel supplied to the engine sufficient to protect the engine against over speeding.

In order to provide what is termed in the art "torque control", an adjustable maximum fuel stop is provided. The adjustment of a maximum fuel stop is effected indirectly by the weight mechanism as will be described. The maximum fuel stop is constituted by the shaped surface of an angularly movable cam 70 with which is engageable a roller 71 mounted upon a pin extending laterally from a part 15*a* secured to the control rod 15. The cam 70 is angularly movable and for this purpose it is mounted about a pivot pin not shown, which is journalled within a housing 72. This housing is mounted on an angularly adjustable plate 73 freely mounted about a shaft 74 extending transversely across the chamber. The plate is in fact carried on a boss 75 and has a projection portion which is engageable with an abutment 76 adjustable from exterior of the housing. The pivot which carries the cam 70 is secured to a lever 77 (FIG. 5) and this in turn is coupled to one end of a link 78 which extends downwardly within the chamber and is coupled to a further lever 79 secured to one end of a boss 80 angularly movable about a pin 81. The pin 81 is secured within the housing and it is coaxial with the pin 31. Also provided is a generally U-shaped link member 82, one limb 83 of which is pivotally mounted about the pin 81 whilst the other limb is supported by the pin 32, and 48 carried by the rockable member 30. The limb 83 carries a pin 84 and this is engaged with one end of a coiled torsion spring 85 which is located about the boss 80. The other end of the torsion spring is coupled to the boss and the arrangement is such that when the member 30 moves about the pin 31, the link member is also moved and the movement of the link member is transmitted to the further lever 79 by way of the spring 85 which is preloaded. The relative angular position of the limb 83 and the further lever 79 is determined by an adjuster 87. Movement of the further lever will effect movement of the lever 77 through the intermediary of the link 78, and movement of the lever 77 will effect movement of the cam 70. In this manner the maximum amount of fuel which can be supplied by the apparatus is determined by the abutment of the roller with the cam and since the position of the cam is dependent upon the speed at which the apparatus is driven, the maximum fuel which can be supplied to the engine will also vary in accordance with the speed of the engine.

The governor mechanism also includes means whereby the supply of fuel to the engine can be stopped when so required. This is effected by a stop control which effects angular movement of the shaft 74*a*. Coupled to the shaft 74*a* is a lever 86 engageable with a part secured to the control rod and operable to move the control rod to the zero fuel position. The link 34 is provided to minimise strain on the governor mechanism in the event that for example the stop control is operated whilst the throttle pedal is fully depressed. The spring 85 which constitutes a yieldable connection between the further lever 79 and the limb 83 is provided for the purpose of ensuring that when the control rod is in the excess fuel position in which position the roller 71 is clear of the cam 70, then when the engine speed increases, the movement of the governor linkage will not be prevented by abutment of the cam 70 with the roller 71. The roller 71 can therefore be moved by the governor mechanism and when it is clear of the cam, the cam can return to its correct position to thereafter limit the maximum amount of fuel which can be supplied to the engine. The supply of excess fuel to the engine for starting purposes can be obtained when the engine is at rest, by depression of the throttle pedal. The cam 70 is so shaped that in the rest position it does not constitute a maximum fuel stop and therefore the control rod can be moved to an excess fuel position.

When the engine with which the pumping apparatus and governor mechanism are associated is driving a vehicle with provision for power take off a difficulty arises as has been explained. In order to overcome this difficulty means is provided for reducing the preload of the spring 25 when use of the power take off coupling is required.

In the arrangement shown in FIG. 1 the preload of the spring 25 is determined by an abutment 26 which is mounted on a plate hinged about the pin 27. The setting of the plate can be determined from exterior of the housing by means of an adjustor which in use is preset at the factory to ensure that the maximum safe speed of the engine is not exceeded. The mechanism as shown in FIG. 1 is modified by utilising a different cover which is more clearly seen in FIG. 7. The new cover is referenced 90 and instead of the abutment mounted on the hinge plate, a cam 91 is mounted upon a shaft 92. The shaft 92 extends to the periphery of the housing and as shown in FIG. 6, it is coupled to a lever 93. Moreover, it carries a pair of abutments 94, 95 engageable with a pair of adjustable stops 96, 97 respectively. The lever 93 is biassed by means of a spring not shown, in the clockwise direction to the point at which the abutment 94 engages with the stop 96. This corresponds to the maximum preload position of the spring 25 and therefore the stop 96 represents the maximum speed stop. When the lever 93 is moved against the action of its spring to the point where the abutment 95 engages the stop 97, the preload on the spring 25 is at a minimum or zero.

In use, the lever 93 is coupled to a hand control (not shown) whereby the lever 93 can be retained in the position in which the abutment 95 engages the stop 97. The hand control is operated when it is required to use the power take off coupling of the vehicle without driving the vehicle.

The reduction of the preload of the spring 25 does not mean that the engine will operate at the new reduced speed since it is necessary for the shaft 42 to be rotated in the anti-clockwise direction to ensure that the amount of fuel supplied to the engine is sufficient to enable the engine to operate at the reduced maximum speed. As shown in FIG. 6, the shaft 42 is coupled to a lever 98 which is biassed by means of a spring not shown, in the clockwise direction. The lever 98 is moved in the anti-clockwise direction by depression of the throttle control of the vehicle to increase the rate of fuel supply to the engine. The two levers 93, and 98 are connected by a link 99, one end of the link 99 being pivotally connected to the lever 93 whilst the lever 98 carries a peg 100 slidable within a slot 101 formed in the link 99. An adjustable abutment 102 is located in the slot and the arrangement is such that when the lever 93 is moved in the anti-clockwise direction for the purpose of operating the device connected to the power take off coupling, the abutment 102 will at some point engage the peg 100 and move the lever 98 in the anti-clockwise direction. Movement of the lever ensures that the engine receives sufficient fuel to enable it to run at the reduced speed and provide sufficient power to drive the device connected to the power take off coupling. If the load imposed by the aforesaid device should fall, then the engine speed will tend to increase but the governing action will compensate for this by reducing the amount of fuel supplied to the engine. Conversely, if the load should increase, then the reduction in engine speed will cause the governor to increase the supply of fuel to the engine. The abutment 102 is adjustable to preset the speed at which the engine will operate.

The slot 101 permits the lever 98 to be moved independently of the lever 93 when the power take off coupling is not in use.

Figure 8:
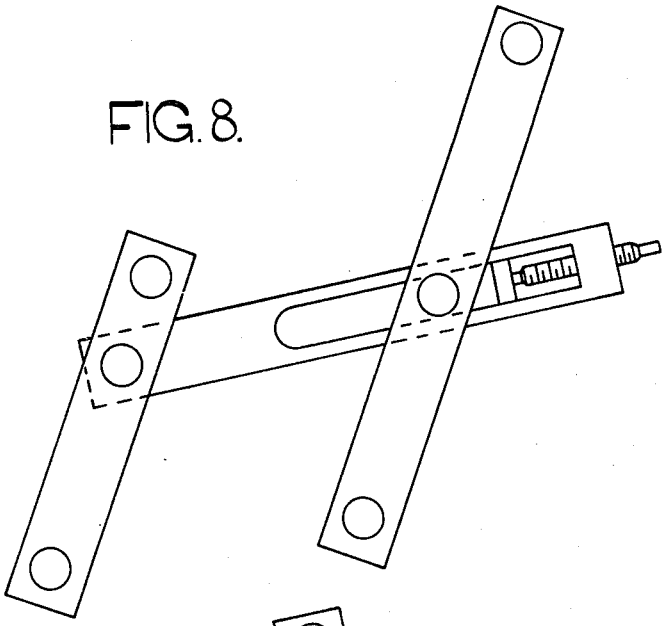

FIGS. 8, 9 and 10 show different settings of the two levers. FIG. 8 corresponds to engine idling without the power take off coupling in use. FIG. 9 shows the situation with the engine operating at maximum speed again without the power take off coupling in use. FIG. 10 shows the setting of the two levers when the lever 93 has been moved angularly in the anti-clockwise direction for the purpose of power take off.

FIG. 11 is a diagram showing engine speed plotted against the quantity of fuel supplied to the engine. The engine is operated within the limits A, B, C, D. The position of the line C D is determined by the weight unit in conjunction with the spring 25 whilst the line A B is determined by the weight unit and the idling spring 22. The line B C is the maximum fuel line and it is determined by the cam 70.

The line G H is one of a family of such lines corresponding to different positions of the pivot point of the lever 33. If the engine is operating at the point I on the line G H then as the engine speed decreases the amount of fuel will be increased and vice versa.

The line J K is of the same family as the line G H but it is curved to the extent that at its low speed end it is almost parallel with the axis A D. The reason for this is firstly the adverse lever ratio of the lever 33 and the reduced force variation available from the weight unit for a given movement of the sleeve 20 owing to the fact that the weights 18 are closed. Thus if the engine is operating at point L the ability of the mechanism to control engine speed variation will be less than when the engine is operating at point I on the line G H and the engine speed will fluctuate appreciably as the load is varied.

With the preload of the spring 25 reduced the weights 18 will move further outwardly for a given speed so that the variation of force produced by the weight unit for a given change in speed is increased. This alone will improve the governing ability but since the sleeve will have moved towards the right as seen in FIG. 1 the block 39 must also be moved towards the right to maintain the same delivery of fuel. In order to move the block towards the right it must be moved downwardly and this alters the lever ratio so that for a given movement of the sleeve there is increased movement of the control rod again providing an improvement in the governing ability. The line E F on FIG. 11 shows a typical working line of the governor mechanism when the power take off coupling is in use.

It will be appreciated that the setting of the link 93 may be achieved in a number of ways. It can be connected to the hand control by a Bowden cable alternatively its position may be set in some other manner as for example by a solenoid or some other electromechanical device.

We claim:

1. A governor mechanism for use with or forming part of a fuel injection pumping apparatus for supplying fuel to an internal combustion engine, the mechanism comprising:

a centrifugal weight unit which in use, is driven at a speed proportional to the speed of the associated engine, a first resilient means acting against a member in opposition to the force exerted by said weight unit, means for limiting the deflection of said first resilient means, a second preloaded resilient means which defines a reaction member for said first resilient means, the preload of said second resilient means being substantially equal to the force required to deflect the first resilient means to its maximum permitted extent whereby with increasing engine speed said opposition member is moved continuously against the action of said first and second resilient means, a first lever pivotally mounted intermediate its ends for coupling to said opposition member, means coupling one end of the first lever to said opposition member, so that the first lever is pivoted about its pivot upon movement of said opposition member, further means connecting the other end of the first lever to a control member of the pumping apparatus, manually adjustable means for varying the position of said pivot, whereby for a given position of said opposition member below the maximum speed of the engine, when the pivot is moved in one direction, the first lever will pivot in a direction which effects an increase in the amount of fuel supplied to the engine, and when the pivot is moved to the other direction, the lever will pivot in a direction which effects a reduction in the amount of fuel supplied to the engine, extra means for adjusting the preload of said second resilient means and linkage means coupled to said extra means, as well as to said manually adjustable means whereby, when said linkage means is set to reduce the preload of said second resilient means, the pivot will be positioned such that said lever will be moved to a position to ensure a supply of fuel by the pumping apparatus, said linkage means being operable from the exterior of the governor mechanism to reduce the preload of said second resilient means when it is required to operate the engine at a reduced speed with a varying load.

2. A governor mechanism according to claim 1 including lost motion means forming part of said linkage means and operable to allow said manually adjustable means to be moved to effect and increase in the supply of fuel by the pumping apparatus without movement of said extra means.

3. A governor mechanism according to claim 1 in which said second resilient means comprises a leaf spring one end of which is pivotally mounted in a housing of the governor mechanism and the other end of which forms the reaction member for said first resilient means, and in which said extra means comprises a cam operable from the exterior of the housing, said cam engaging with the leaf spring intermediate its ends, the cam being mounted upon an angularly adjustable shaft extending to the exterior of the housing.

4. A governor mechanism for use with or forming part of a fuel injection pumping apparatus for supplying fuel to an internal combustion engine, the mechanism comprising:

a housing, a centrifugal weight unit disposed in said housing, which is driven at a speed proportional to the speed of the associated engine, a first resilient means acting against a member in opposition to the force exerted by said weight unit, means for limiting the deflection of said first resilient means, a second preloaded resilient means which defines a reaction member for said first resilient means, the preload of said second resilient means being substantially equal to the force required to deflect the first resilient means to its maximum permitted extent, whereby with increasing engine speed, said opposition member is moved continuously against the action of said first and second resilient means, said second resilient means comprising a leaf spring one end of which is pivotally mounted in said housing, and the other end of which forms the reaction member for said first resilient means, a first lever pivotally mounted intermediate its ends for coupling said opposition member, means coupling one end of the first lever to said opposition member so that the first lever is pivoted about its pivot upon movement of said opposition member, further means connecting the other end of the first lever to a control member of the pumping apparatus, manually adjustable means for varying the position of said pivot whereby for a given position of said opposition member, below the maximum speed of the engine, when the pivot is moved in one direction, the first lever will pivot in a direction which effects an increase in the amount of fuel supplied to the engine, and when the pivot is moved in the other direction, the lever will pivot in a direction which effects a reduction in the amount of fuel supplied to the engine, extra means for adjusting the preload of said second resilient means and linkage means coupled to said extra means, said linkage means being operable from exterior of the governor mechanism to reduce the preload of said second resilient means when it is required to operate the engine at a reduced speed with a varying load, said extra means comprising a cam operable from the exterior of the housing, said cam engaging with the leaf spring intermediate its ends, said cam being mounted upon an angularly adjustable shaft extending to the exterior of said housing, said linkage means comprising a second lever mounted on the adjustable shaft which carries the cam, a third lever mounted upon a shaft which forms said manually adjustable means and a link connecting said second and third levers.

5. A governor mechanism according to claim 4 in which said link is pivotally mounted to said second lever and a lost motion connection is provided between the link and said third lever.

6. A governor mechanism according to claim 5 in which said link is provided with an axial slot and said third lever mounts a peg slidable within said slot.

7. A governor mechanism according to claim 6 including an adjustable abutment in said slot, said abutment being positioned to engage said peg as said second lever is moved in the direction to reduce the preload of the leaf spring.

8. A governor mechanism according to claim 8 including stop means operable to determine the extremes of movement of the adjustable shaft which carries said cam.

* * * * *